US008955486B2

(12) United States Patent
Azevedo et al.

(10) Patent No.: US 8,955,486 B2
(45) Date of Patent: Feb. 17, 2015

(54) PISTON WITH ENHANCED COOLING GALLERY

(75) Inventors: Miguel Azevedo, Ann Arbor, MI (US); Warran Boyd Lineton, Ann Arbor, MI (US); Keith Hampton, Ann Arbor, MI (US)

(73) Assignee: Federal Mogul Corporation, Southfield, MI (US)

( * ) Notice: Subject to any disclaimer, the term of this patent is extended or adjusted under 35 U.S.C. 154(b) by 270 days.

(21) Appl. No.: 13/370,609

(22) Filed: Feb. 10, 2012

(65) Prior Publication Data

US 2013/0206094 A1 Aug. 15, 2013

(51) Int. Cl.
*F02F 3/26* (2006.01)

(52) U.S. Cl.
USPC ..... 123/193.6; 123/41.35

(58) Field of Classification Search
USPC ..... 123/193.6, 41.35; 92/186, 187
See application file for complete search history.

(56) References Cited

U.S. PATENT DOCUMENTS

| | | | | |
|---|---|---|---|---|
| 1,678,957 | A | | 1/1926 | Phillip |
| 1,878,566 | A | | 2/1929 | Woolson |
| 1,820,628 | A | | 8/1931 | Niven |
| 1,876,917 | A | | 9/1932 | Gosslau |
| 1,905,582 | A | | 4/1933 | Gazda |
| 1,953,109 | A | | 4/1934 | Heron |
| 2,126,306 | A | | 8/1938 | Bernard |
| 2,153,501 | A | | 4/1939 | Harper, Jr. |
| 2,155,383 | A | | 4/1939 | Carr |
| 3,385,375 | A | | 5/1968 | Pratt |
| 3,545,341 | A | | 12/1970 | Fischer |
| 3,616,729 | A | | 11/1971 | Fischer |
| 3,703,126 | A | * | 11/1972 | Haug ..... 92/186 |
| 4,356,800 | A | * | 11/1982 | Moebus ..... 123/193.6 |
| 4,493,292 | A | | 1/1985 | Showalter |
| 4,587,932 | A | * | 5/1986 | Moebus ..... 123/41.35 |
| 5,339,775 | A | | 8/1994 | Clarke et al. |
| 6,026,777 | A | * | 2/2000 | Kemnitz et al. ..... 123/193.6 |

(Continued)

FOREIGN PATENT DOCUMENTS

| | | | |
|---|---|---|---|
| DE | 19915782 | A1 | 11/2000 |
| JP | S53154907 | U | 12/1978 |

(Continued)

OTHER PUBLICATIONS

International search report mailed Apr. 19, 2013 (PCT/US2013/025256).

*Primary Examiner* — M. McMahon
(74) *Attorney, Agent, or Firm* — Robert L. Stearns; Dickinson Wright, PLLC

(57) ABSTRACT

A piston for an internal combustion engine has a body including an upper combustion wall having an upper combustion surface; cylindrical outer wall with a ring belt region adjacent the upper combustion surface, and a closed annular cooling gallery located in radial alignment with the ring belt region. A cooling medium is contained in the cooling gallery. The cooling gallery has an inner surface including a radially outermost portion extending along the ring belt region. The outermost portion converges from the upper combustion wall toward a longitudinal central axis. During reciprocating motion of the piston, the cooling medium flows and remains in contact with the cooling gallery walls, thereby maximizing the capacity for heat to be transferred from the upper combustion wall to the contained cooling medium and from the cooling medium to the piston body, ring belt region and ultimately to the engine cooling system.

12 Claims, 2 Drawing Sheets

(56) References Cited

U.S. PATENT DOCUMENTS

| | | | | |
|---|---|---|---|---|
| 6,957,638 | B2 * | 10/2005 | Scharp | 123/193.6 |
| 7,628,135 | B2 * | 12/2009 | Messmer | 123/193.6 |
| 8,074,617 | B2 * | 12/2011 | Grahle et al. | 123/193.6 |
| 2007/0137605 | A1 * | 6/2007 | Scharp | 123/193.6 |
| 2010/0275861 | A1 * | 11/2010 | Schneider | 123/41.35 |
| 2011/0226211 | A1 * | 9/2011 | Messmer | 123/193.6 |
| 2013/0146017 | A1 * | 6/2013 | Muscas et al. | 123/193.6 |

FOREIGN PATENT DOCUMENTS

| | | | |
|---|---|---|---|
| JP | 56017335 | U | 2/1981 |
| JP | 57156053 | U | 9/1982 |
| JP | S5924853 | Y2 | 7/1984 |
| JP | H02131055 | U | 10/1990 |

* cited by examiner

PISTON WITH ENHANCED COOLING GALLERY

BACKGROUND OF THE INVENTION

1. Technical Field

This invention relates generally to internal combustion engines, and more particularly to pistons therefor.

2. Related Art

Engine manufacturers are encountering increasing demands to improve engine efficiencies and performance, including, but not limited to, improving fuel economy, improving fuel combustion, reducing oil consumption, increasing the exhaust temperature for subsequent use of the heat within the vehicle, increasing compression loads within the cylinder bores, decreasing weight and making engines more compact. Accordingly, it is desirable to increase the temperature and compression loads within the combustion chamber of the engine. However, by increasing the temperature and compression loads within the combustion chamber, the wear and physical demands on the piston are increased, thereby reducing its potential useful life. A particular area of concern is with the excessive heat buildup and associated wear within the piston ring region of the piston.

A piston constructed in accordance with this invention is able to withstand the excessive heat generated in modern high performance engines, as will become apparent to those skilled in the art upon reading the disclosure and viewing the drawings herein.

SUMMARY OF THE INVENTION

A piston for an internal combustion engine is provided. The piston has a body that extends along a longitudinal central axis. The body includes an upper combustion wall having an upper combustion surface, a cylindrical outer wall with a ring belt region adjacent the upper combustion surface, a pair of pin bosses having pin bores aligned along a pin bore axis beneath the upper combustion wall, and a closed annular cooling gallery located in radial alignment with the ring belt region. A coolant medium is contained in the cooling gallery. The cooling gallery has an inner surface including a radially outermost portion that extends along the ring belt region. The outermost portion converges from the upper combustion wall toward the longitudinal central axis. Accordingly, during a downward stroke of the piston, the cooling medium is caused to flow into contact with the upper combustion wall, thereby allowing heat to be transferred from the upper combustion wall to the cooling medium.

A piston for an internal combustion engine constructed in accordance with another aspect of the invention includes a body extending along a longitudinal central axis. The body includes an upper combustion wall having an upper combustion surface, a cylindrical outer wall with a ring belt region adjacent the upper combustion surface, a pair of pin bosses beneath the upper combustion wall, a closed annular cooling gallery located radially inwardly from the ring belt region, and a cooling medium contained in the cooling gallery. The cooling gallery has an inner surface bounding the cooling gallery. The inner surface includes a web that diverges conically from the upper combustion wall away from the longitudinal central axis to a lowermost valley of the cooling gallery. Accordingly, during a downward stroke of the piston, the cooling medium is caused to flow into contact with the upper combustion wall, thereby allowing heat to be transferred from the upper combustion wall to the cooling medium.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
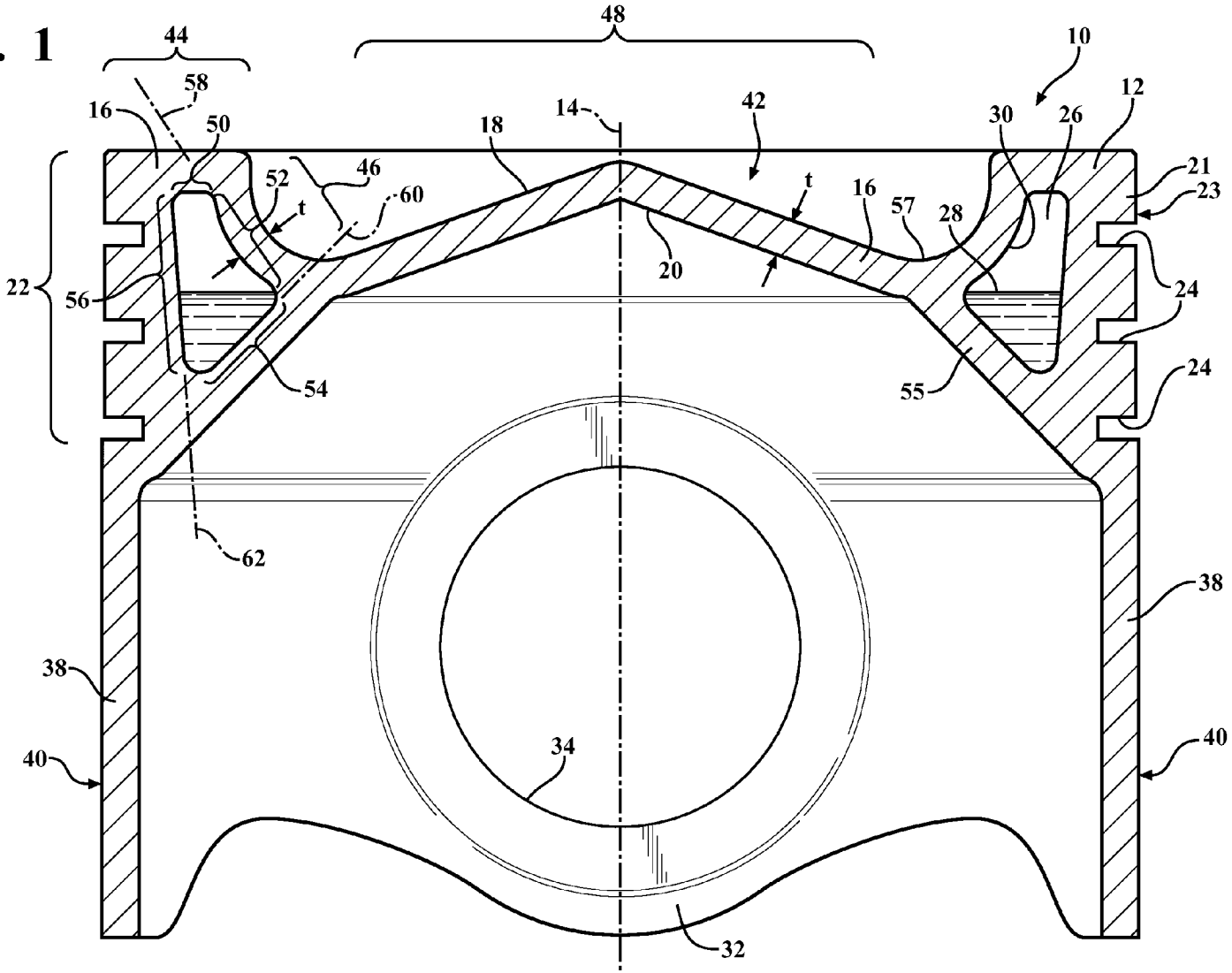
FIG. 1 is a cross-sectional view taken generally along a line extending transversely to a pin bore axis of a piston constructed in accordance with one aspect of the invention.
Figure 2:
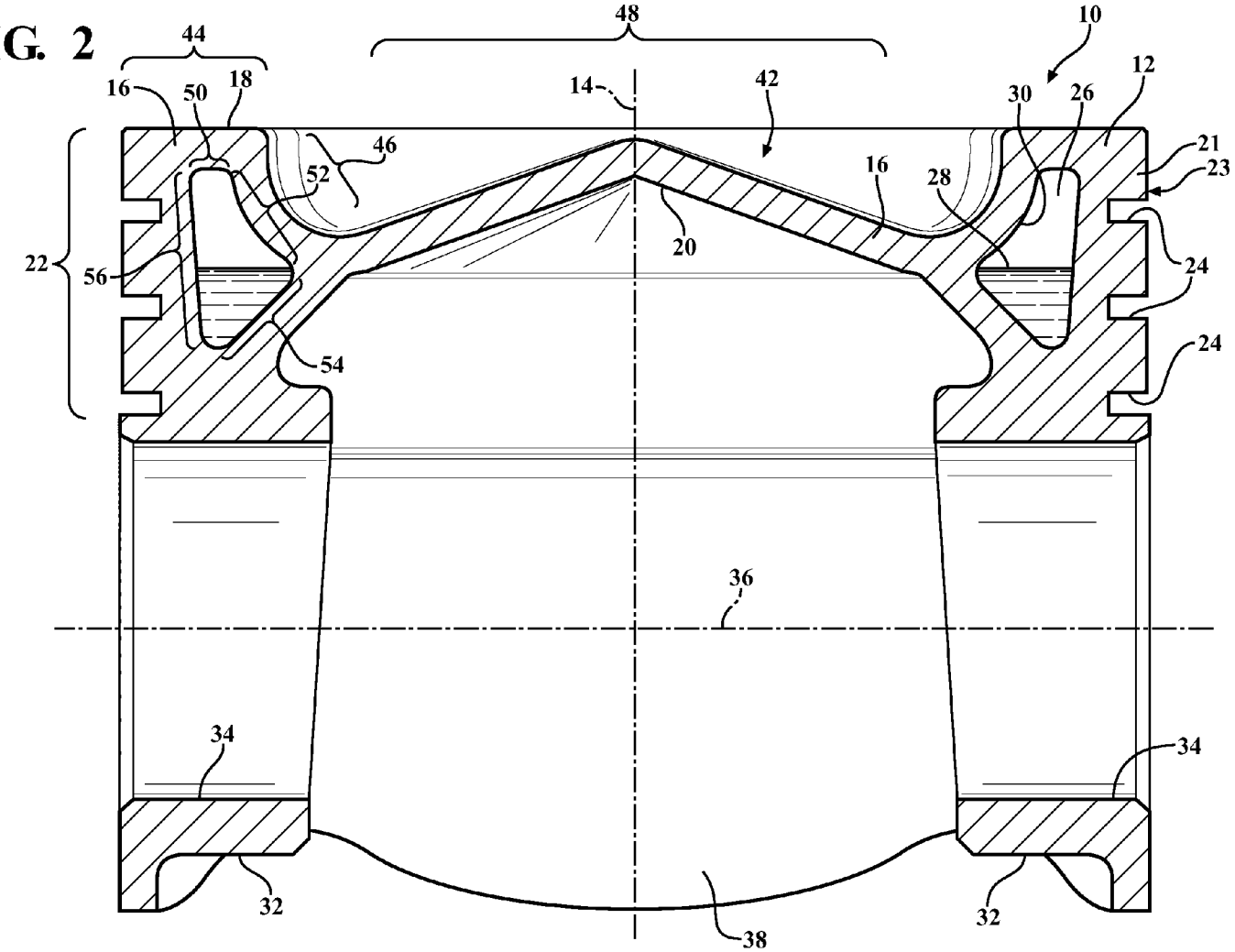
FIG. 2 is a cross-sectional view taken generally along the pin bore axis of the piston of FIG. 1.

Referring in more detail to the drawings, FIGS. 1 and 2 illustrate a cross-sectional view of a piston 10 constructed in accordance with one presently preferred aspect of the invention for reciprocating movement in a cylinder bore of an internal combustion engine, such as a modern, compact, high performance vehicle engine, for example. The piston 10 has a body 12, such as a single, monolithic piece of cast material or formed from either forged or billet materials, by way of example and without limitation, extending along a central longitudinal axis 14 along which the piston 10 reciprocates in the cylinder bore. The body 12 has an upper combustion wall 16 having on one side an upper combustion surface 18 configured for direct exposure to combustion gases within a cylinder bore and on an opposite side an undercrown surface 20 located directly and axially beneath a portion of the upper combustion surface 18. The piston body 12 also includes a generally cylindrical outer wall 21 having a cylindrical outer surface 23 depending from the upper combustion surface 18 over a ring belt region 22 immediately adjacent the upper combustion surface 18. The ring belt region 22 includes one or more piston ring grooves 24 configured for receipt of corresponding piston rings (not shown). Further, the piston body 12 is formed having a closed cooling gallery 26 with a cooling medium 28 disposed therein. The cooling gallery 26 is configured radially inwardly and in substantial radial alignment with the ring belt region 22. The cooling gallery 26 has an uninterrupted, continuous annular inner surface 30 configured in accordance with the invention to enhance the transfer of heat from the upper combustion wall 16 to other portions of the piston body 12, and ultimately facilitating the transfer of heat from the piston body 12 to the cylinder liner and engine block. Accordingly, heat generated within the upper combustion wall 16 is transferred toward the outer surface 23 and ultimately to the cylinder liner and engine block, thereby facilitating reduction of the operating temperature of the upper combustion wall 16, and thus, prolonging the useful life of the piston 10.

The cooling medium 28 can be provided entirely as a metallic coolant, which is liquid at operating temperature of the piston 10. Any suitable lightweight metallic material could be used, taking into account the heat transfer properties desired. Further, the cooling medium 28 can be provided as a liquid metal mixed with powdered metal, such as copper or aluminum. The addition of metallic powder can be used particularly when it is desired to change the specific heat of the cooling medium 28. Further yet, heat transfer liquids, such as those typically used for industrial heat exchanging, can be used.

As best shown in FIG. 2, the piston body 12 has a pair of pin bosses 32 depending from the undercrown surface 20 to provide laterally spaced pin bores 34 coaxially aligned along a pin bore axis 36 that extends generally transverse to the central longitudinal axis 14. The pin bosses 32 are joined to laterally spaced skirt portions 38 that are diametrically spaced from one another across opposite sides the pin bore axis 36 and have convex outer surfaces 40 contoured for sliding movement within the cylinder bore to facilitate maintaining the piston 10 in its desired orientation as it reciprocates within the cylinder bore.

The upper combustion surface 16 is represented as having a combustion bowl 42 recessed therein to provide the desired gas flow within the cylinder bore. As a result of the combustion bowl 42 being recessed within the upper combustion surface 16, the combustion wall 16 has a relatively thin thickness (t) across its entirety, as viewed in axial cross-section. In particular, the combustion wall 16 includes a first region 44, second region 46 and a third region 48, wherein the second and third regions 46, 48 are thinned due to the recessed combustion bowl 42.

The cooling gallery 26 is configured to optimize the cooling effect of the cooling medium 28. In particular, the cooling gallery 26 can be viewed as being bounded by four different portions of the inner surface 30, including an uppermost first portion 50 of the inner surface 30 that extends beneath the first region 44 of the combustion wall 16, an inner second portion 52 of the inner surface 30 that extends along the second region 46 of the combustion wall 16, an inner third portion 54 of the inner surface 30 that extends along a web 55 that diverges from the combustion wall 16 away from the longitudinal central axis 14 to a lowermost valley 57 of the cooling gallery 26 and generally to the outer wall 21, and an outer fourth portion 56 that extends generally along the ring belt region 22 of the outer wall 21. The second, third and fourth portions 52, 54, 56 are inclined having an angular relation in accordance with the invention, relative to the longitudinal axis 14 and pin bore axis 36, to provide the desired fluid flow of the cooling medium 28 within the cooling gallery 26 during reciprocating upward and downward strokes of the piston 10 within the cylinder bore.

The second portion 52 of the inner surface 30 is an upper radially inner portion that extends along a valley portion of the combustion bowl 42 generally along an axis 58 that converges conically from the first portion 50 of the upper combustion wall 16 toward the longitudinal central axis 14. The angle of convergence relative to the longitudinal axis 14 can be selected as desired, such as between 15-75 degrees, and preferably between 30-60 degrees. This angular slope of the second portion 52 causes the cooling medium 28 to be directed radially outwardly toward the outer wall 21 as the piston 10 is moving downwardly during a downward stroke within the cylinder bore, thereby carrying heat away from the upper combustion wall 16 to the outer wall 21, whereupon the heat can be readily transferred to the cylinder liner and engine block.

The third portion 54 of the inner surface 30 is a lower radially inner portion that extends along an axis 60 that diverges conically from the upper combustion wall 16 away from the longitudinal central axis 14 toward the outer wall 21. Then angle of divergence relative to the longitudinal axis 14 can be selected as desired, such as between 15-75 degrees, and preferably between 30-60 degrees. This angular slope of the third portion 54 causes the cooling medium 28 to be directed radially outwardly toward the outer wall 21 as the piston 10 is moving downwardly during a downward stroke within the cylinder bore, thereby carrying heat away from the upper combustion wall 16 to the outer wall 21, whereupon the heat can be readily transferred to the cylinder liner and engine block.

The fourth portion 56 of the inner surface 30 is a radially outermost portion that extends generally along an axis 62 that converges conically from the upper combustion wall 16 toward the longitudinal central axis 14. Then angle of convergence of the axis 62 relative to the longitudinal axis 14 can be selected as desired, such as between 1-30 degrees, and preferably between 10-20 degrees. This angular slope of the fourth portion 56 causes the cooling medium 28 to be directed radially inwardly and thereby efficiently transferring absorbed heat from the combustion wall 16 and the fourth portion 52 to the ring belt region 22 as the piston 10 is moving upwardly during an upward stroke within the cylinder bore. Accordingly, the heat transfer cycle is complete, which allows the efficient transfer of heat from the combustion wall 16 downwardly and outwardly and ultimately to the cylinder liner and engine block.

Obviously, given the detailed description of presently preferred embodiments discusses above, many modifications and variations of the present invention are possible in light of the above teachings. It is, therefore, to be understood that within the scope of the appended claims, the invention may be practiced otherwise than as specifically described.

What is claimed is:

1. A piston for an internal combustion engine, comprising:

a body extending along a longitudinal central axis, said body including an upper combustion wall having an upper combustion surface, a cylindrical outer wall with a ring belt region adjacent said upper combustion surface, a pair of pin bosses beneath said upper combustion wall;

a closed annular cooling gallery located radially inwardly from said ring belt region;

a cooling medium contained in said cooling gallery; and said cooling gallery having an inner surface bounding said cooling gallery, said inner surface including a radially outermost portion that extends along an axis that converges from said upper combustion wall toward said longitudinal central axis, wherein said radially outermost portion extends along said ring belt region, and wherein said axis along which said radially outermost portion extends is inclined between 1-30 degrees relative to said longitudinal central axis.

2. The piston of claim 1 wherein said axis along which said radially outermost portion extends is inclined between 10-20 degrees relative to said longitudinal central axis.

3. The piston of claim 1 further including a combustion bowl recessed within said upper combustion wall.

4. The piston of claim 2 wherein said inner surface includes an upper inner portion that extends along a portion of said combustion bowl along a second axis that converges from said upper combustion wall toward said longitudinal central axis, wherein said second axis is inclined between 30-60 degrees relative to said longitudinal central axis.

5. The piston of claim 4 wherein said inner surface includes a lower inner portion that diverges along a third axis from said upper combustion wall away from said longitudinal central axis, wherein said third axis is inclined between 30-60 degrees relative to said longitudinal central axis.

6. The piston of claim 1 further including a web diverging from said upper combustion wall away from said longitudinal central axis, said web providing a portion of said inner surface.

7. The piston of claim 6 further including a combustion bowl recessed within said upper combustion wall.

8. The piston of claim 6 wherein said web diverges conically from said upper combustion wall away from said longitudinal central axis.

9. A piston for an internal combustion engine, comprising:

a body extending along a longitudinal central axis, said body including an upper combustion wall having an upper combustion surface, a cylindrical outer wall with a ring belt region adjacent said upper combustion surface, a pair of pin bosses beneath said upper combustion wall;

a closed annular cooling gallery located radially inwardly from said ring belt region;

a cooling medium contained in said cooling gallery; and said cooling gallery having an inner surface bounding said cooling gallery, said inner surface including a web that diverges conically from said upper combustion wall away from said longitudinal central axis to a lowermost valley of said cooling gallery, wherein said inner surface includes a radially outermost portion that extends along an axis that converges from said upper combustion wall toward said longitudinal central axis, said radially outermost portion extends along said ring belt region, and wherein said axis along which said radially outermost portion extends is inclined between 1-30 degrees relative to said longitudinal central axis.

10. The piston of claim 9 further including a combustion bowl recessed within said upper combustion wall.

11. The piston of claim 9 wherein said inner surface includes an upper inner portion that extends along a portion of said combustion bowl along a second axis that converges from said upper combustion wall toward said longitudinal central axis, wherein said second axis is inclined between 30-60 degrees relative to said longitudinal central axis.

12. The piston of claim 11 wherein said inner surface includes a lower inner portion that diverges along a third axis from said upper combustion wall away from said longitudinal central axis, wherein said third axis is inclined between 30-60 degrees relative to said longitudinal central axis.

* * * * *